US010883204B2

(12) United States Patent
Shimizu et al.

(10) Patent No.: US 10,883,204 B2
(45) Date of Patent: Jan. 5, 2021

(54) CONDUCTIVE WOVEN FABRIC, CONDUCTIVE MEMBER AND PROCESS FOR PRODUCING CONDUCTIVE WOVEN FABRIC

(71) Applicant: SEIREN CO., LTD., Fukui (JP)

(72) Inventors: Yoshihiro Shimizu, Fukui (JP); Nobuaki Ankyu, Fukui (JP)

(73) Assignee: SEIREN CO., LTD., Fukui (JP)

( * ) Notice: Subject to any disclaimer, the term of this patent is extended or adjusted under 35 U.S.C. 154(b) by 121 days.

(21) Appl. No.: 16/362,817

(22) Filed: Mar. 25, 2019

(65) Prior Publication Data

US 2019/0301058 A1 Oct. 3, 2019

(30) Foreign Application Priority Data

Mar. 30, 2018 (JP) ..... 2018-067141

(51) Int. Cl.
*D03D 15/00* (2006.01)
*D03D 1/00* (2006.01)
(Continued)

(52) U.S. Cl.
CPC ..... *D03D 13/004* (2013.01); *D03D 1/0088* (2013.01); *D03D 13/008* (2013.01);
(Continued)

(58) Field of Classification Search
CPC .... D02G 3/441; D03D 1/0058; D03D 13/008; D03D 15/00; D03D 15/02;
(Continued)

(56) References Cited

U.S. PATENT DOCUMENTS 4,557,968 A * 12/1985 Thornton ..... B01D 39/083 442/198
4,582,747 A * 4/1986 Hirakawa ..... D03D 1/0023 428/315.5
(Continued)

FOREIGN PATENT DOCUMENTS

JP 2007-027221 2/2007
JP 2013-213262 12/2016
(Continued)

*Primary Examiner* — Robert H Muromoto, Jr.
(74) *Attorney, Agent, or Firm* — Wenderoth, Lind & Ponack, L.L.P.

(57) ABSTRACT

A conductive woven fabric consisting of multiple weft yarns and multiple warp yarns and having at least one conductive part, wherein one of weft and warp is consisting of non-conductive yarns and the other of weft and warp is consisting of conductive yarns and non-conductive yarns which are parallel to each other, characterized in that said non-conductive yarns parallel to the conductive yarns are shrinking-processed yarns and the conductive part is formed by a repeating woven structure wherein the conductive yarns pass through the upper side of at least two of non-conductive yarns orthogonal to the conductive yarns and then pass through the back side of at least one of non-conductive yarns orthogonal to the conductive yarns, and a process for producing the same, and also provides a conductive member using the same.

9 Claims, 2 Drawing Sheets

(51) Int. Cl.

| | |
|---|---|
| ***D03D 13/00*** | (2006.01) |
| ***D06M 11/83*** | (2006.01) |
| ***H01B 5/14*** | (2006.01) |
| ***H01B 13/00*** | (2006.01) |
| *D06M 101/32* | (2006.01) |

(52) U.S. Cl.
CPC ..... *D03D 15/00* (2013.01); *D06M 11/83* (2013.01); *H01B 5/14* (2013.01); *H01B 13/0036* (2013.01); *D03D 2700/0137* (2013.01); *D03D 2700/0166* (2013.01); *D06M 2101/32* (2013.01); *D10B 2101/20* (2013.01); *D10B 2331/04* (2013.01); *D10B 2401/16* (2013.01)

(58) Field of Classification Search
CPC ..... D03D 15/0005; D03D 15/0027; D03D 1/0035; D03D 13/004; D03D 15/0077; D03D 1/0088; D03D 1/00; D06M 11/83; H01B 13/0036; H01B 1/22; H01B 5/12; H01B 5/14; H01B 7/183; H01B 7/1875
See application file for complete search history.

(56) References Cited

U.S. PATENT DOCUMENTS 4,840,202 A * 6/1989 Feustel ..... D02G 3/441 139/425 A
6,057,032 A * 5/2000 Green ..... D02G 3/441 428/359
6,432,850 B1 * 8/2002 Takagi ..... D02G 3/441 428/373
6,615,572 B2 * 9/2003 Takagi ..... D02G 3/441 2/901
6,787,488 B2 * 9/2004 Takagi ..... D03C 15/00 442/110
6,924,244 B2 * 8/2005 Takagi ..... D02G 3/441 442/181
10,542,645 B2 * 1/2020 Simoens-Seghers ..... H05K 9/0067
10,731,726 B2 * 8/2020 Thomas ..... F16G 5/08
10,737,461 B2 * 8/2020 Sasaki ..... H05K 1/038
2003/0054719 A1 * 3/2003 Takagi ..... D02G 3/441 442/190
2010/0084179 A1 * 4/2010 Harris ..... H02G 3/0481 174/350
2010/0212952 A1 * 8/2010 Abdelmoula ..... H01B 1/22 174/390
2010/0279572 A1 * 11/2010 Fujita ..... C09K 3/16 442/195
2014/0246109 A1 * 9/2014 Walton ..... B32B 27/12 138/123
2014/0262478 A1 * 9/2014 Harris ..... D03D 1/0035 174/393

FOREIGN PATENT DOCUMENTS

JP 2016-213270 12/2016
JP 2017-056621 3/2017

* cited by examiner

[Fig. 1]
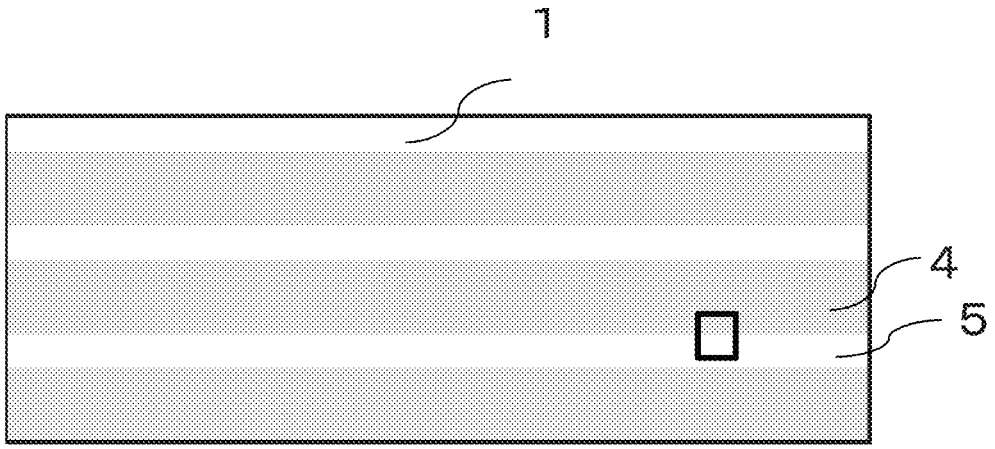

[Fig. 2]
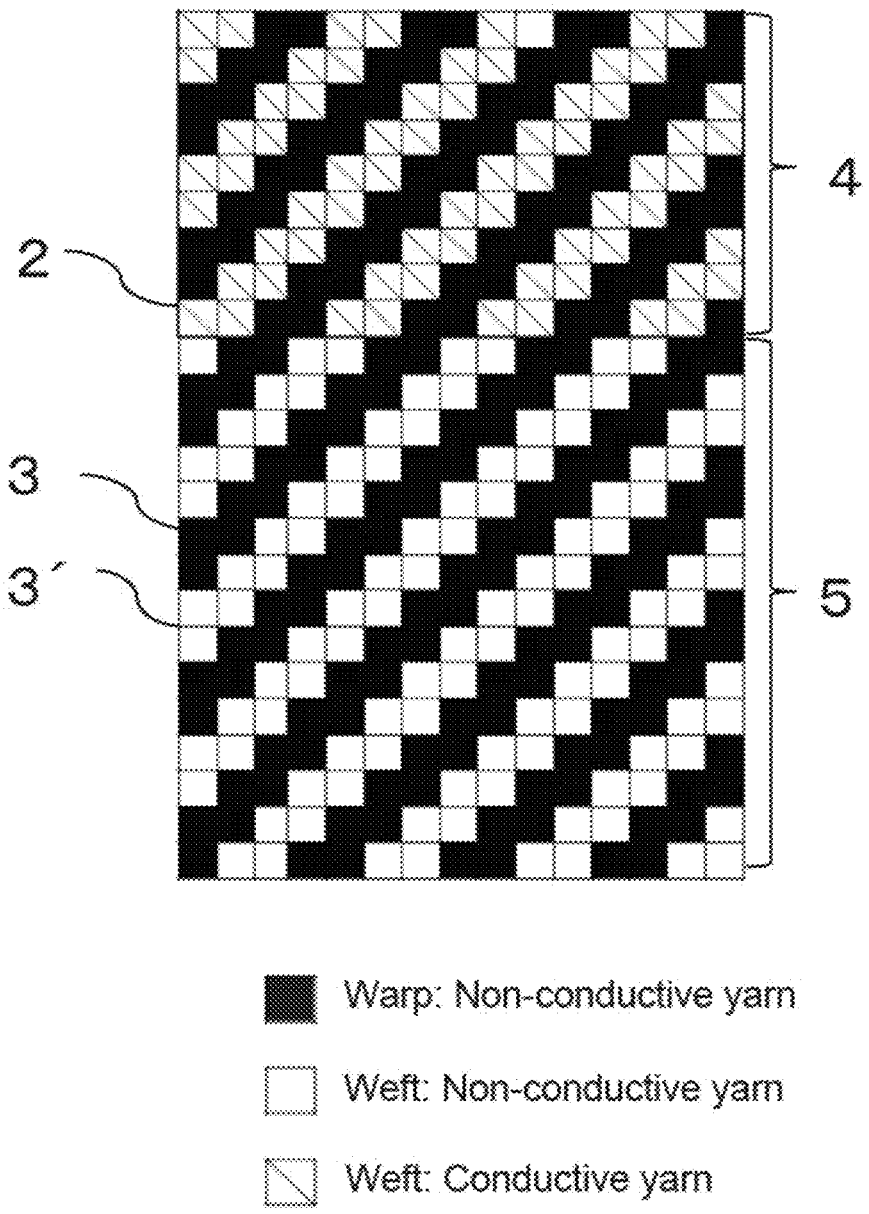

CONDUCTIVE WOVEN FABRIC, CONDUCTIVE MEMBER AND PROCESS FOR PRODUCING CONDUCTIVE WOVEN FABRIC

TECHNICAL FIELD

The present invention relates to a conductive woven fabric, a conductive member and a process for producing a conductive woven fabric.

In detail, the present invention relates to a conductive woven fabric used for a conductive member which exhibits electric conductivity over a linear bending part, excellent in conductivity even after bended repeatedly; a conductive member using the same; and a process for producing said conductive woven fabric.

BACKGROUND ART

With the size reduction of an electronic apparatus, it is also required to reduce the size and the thickness of conductive members used therein. In addition, many devices such as notebook computers, tablet computers and portable game devices have a foldable structure. In such a case, usually, a conductive member corresponding to the foldable structure is used. However, it used to be difficult to keep conductivity after repeatedly bending. Particularly, as the devices become downsized and thinned, the bending radius becomes smaller, and that causes more difficulty in keeping sufficient conductivity.

In the past, a flexible printed circuit board (FPC board) has been used for a device having conductivity over a bending part. However, when the device is bent at a sharp angle such as a bending radius of 0.5 mm or less, it might cause a trouble such as breaking of the base resin film.

For example, Patent Document 1 discloses a method wherein a regulation film that regulates a decrease in the radius of curvature of a bent section is provided inside the bent section of a flexible printed circuit board. According to this method, however, the thickness of the flexible printed circuit board might partially increase to prevent downsizing and thinning of the device. Moreover, the method, which restrains the bending radius from becoming small, might cause a problem such that the circumference of a bending part becomes bulky.

On this basis, Patent Document 2, for example, discloses a conductive member having a conductive woven fabric that exhibits highly durable conductivity against a repeated bending with a small bending radius, wherein an angle formed between a linear bending part and woven fibers of the conductive woven fabric is determined within the specific range. However, it is still required to provide a conductive member which is highly excellent in bending durability.

In order to improve bending durability, it can also be considered to use a conductive woven fabric having a linear circuit obtained by weaving conductive yarns and non-conductive yarns. In this case, however, there has been a problem such as occurrence of wrinkles and/or curls caused by the difference between the shrinkage of conductive yarns and the shrinkage of non-conductive yarns.

PRIOR ART DOCUMENTS

Patent Document

Patent Document 1: Jpn. Pat. Laid-Open Publication No. 2007-027221

Patent Document 2: Jpn. Pat. Laid-Open Publication No. 2017-056621

DISCLOSURE OF THE INVENTION

Problems to be Solved by the Invention

The present invention is to solve the above-described problems and intends to provide a conductive woven fabric excellent in bending durability, conductivity and shape stability.

Means for Solving the Problems

The present invention provides a conductive woven fabric consisting of multiple weft yarns and multiple warp yarns and having at least one conductive part, wherein one of weft and warp is consisting of non-conductive yarns and the other of weft and warp is consisting of conductive yarns and non-conductive yarns which are parallel to each other, characterized in that said non-conductive yarns parallel to the conductive yarns, hereinafter "parallel non-conductive yarns", are shrinking-processed yarns and said conductive part is formed by a repeating woven structure wherein said conductive yarns pass through the upper side of at least two of non-conductive yarns orthogonal to said conductive yarns, hereinafter "orthogonal non-conductive yarns", and then pass through the back side of at least one of orthogonal non-conductive yarns.

It is preferable that the rate of the heat shrinkage percentage of the shrinking-processed yarns to the heat shrinkage percentage of the conductive yarns, (the heat shrinkage percentage of the parallel shrinking-processed non-conductive yarns)/(the heat shrinkage percentage of the conductive yarns), is within the range of 0.25 to 1.75.

It is preferable that the conductive part is formed by a repeating woven structure wherein said conductive yarns pass through the upper side of 2 to 7 of orthogonal non-conductive yarns and then pass through the back side of 2 to 7 of orthogonal non-conductive yarns.

It is preferable that the weaving density of warp is within the range of 100/2.54 cm to 300/2.54 cm and the weaving density of weft is within the range of 100/2.54 cm to 300/2.54 cm.

It is preferable that the total fineness of said conductive yarns and non-conductive yarns is each within the range of 22 to 110 dtex.

It is preferable that the resistance value of said conductive yarns is 500n/m or less.

The present invention also relates to a conductive member comprised of the above-described conductive woven fabric and a support, which has at least one linear bending part and exhibits conductivity over said linear bending part.

The present invention further relates to a process for producing a conductive woven fabric consisting of multiple weft yarns and multiple warp yarns and having at least one conductive part, which comprises a process of forming said conductive part, using non-conductive yarns as one of weft and warp and using conductive yarns and shrinking-processed non-conductive yarns as the other of weft and warp, by repeatedly weaving so that said conductive yarns pass through the upper side of at least two of orthogonal non-conductive yarns and then pass through the back side of at least one of orthogonal non-conductive yarns.

In the above-described process, it is preferable that the rate of the heat shrinkage percentage of the parallel shrinking-processed non-conductive yarns to the heat shrinkage percentage of the conductive yarns is within the range of 0.25 to 1.75.

Effect of the Invention

According to the present invention, a conductive woven fabric excellent in bending durability, conductivity and shape stability can be provided.

BRIEF DESCRIPTION OF DRAWINGS

FIG. 1 is an outline drawing showing a conductive woven fabric which is one of the embodiments of the present invention.

FIG. 2 is a fabric structural diagram showing a woven structure of a part of the conductive woven fabric shown in FIG. 1.

MODES FOR CARRYING OUT THE INVENTION

The conductive woven fabric of the present invention is consisting of multiple weft yarns and multiple warp yarns and has a conductive part. One of weft and warp is consisting of non-conductive yarns and the other of weft and warp is consisting of conductive yarns and non-conductive yarns parallel to said conductive yarns. Examples of the combinations of weft and warp include a combination wherein weft is consisting of non-conductive yarns and warp is consisting of non-conductive yarns and conductive yarns, and a combination wherein warp is consisting of non-conductive yarns and weft is consisting of non-conductive yarns and conductive yarns.

The conductive yarn used for the present invention has a structure wherein the surface of a yarn formed by fibers is coated with metal. Examples of the fibers include natural fibers such as cotton and hemp, recycled fibers such as cupra and rayon, and synthetic fibers such as nylon, polyester and acrylic fiber, though not particularly limited to them.

Among them, synthetic fibers are preferable in terms of strength and general versatility. Polyester is more preferable in terms of high shape stability after heating. Examples of polyester include polyethylene terephthalate (PET), polybutylene terephthalate (PBT) and polytrimethylene terephthalate (PTT).

Preferable forms of a yarn include a filament yarn such as a monofilament yarn and a multifilament yarn. Either one of them can be used. A multifilament yarn is more preferable.

With the size reduction of an electronic apparatus, it is also required to reduce the size and the thickness of conductive members used internally. Therefore, the total fineness of the conductive yarn is preferably 110 dtex or less, more preferably 50 dtex or less. In order to improve the strength of the woven fabric, on the other hand, the total fineness thereof is preferably 22 dtex or more, more preferably 33 dtex or more.

From the viewpoint of bending durability, the number of filaments in a yarn is preferably at least 5, more preferably at least 10.

The single fiber fineness of the conductive yarn is preferably 7 dtex or less from the viewpoint of shape stability.

Examples of materials used for metal coating on the conductive yarn include a metallic material comprising mainly of gold, silver, copper, nickel, tin and the like. Preferable examples of said metallic materials include silver in terms of the balance of conductivity and cost. Examples of methods for forming a metal coating film onto a yarn formed by fibers to obtain a metal-coated yarn include electrolytic plating, electroless plating and vapor deposition. Among them, electroless plating is preferable because it is excellent in productivity, and it can form a uniform metal coating film easily, and therefore it enables to obtain stable conductivity and environmental durability.

The thickness of the metal coating film is preferably 0.075-0.50 μm, more preferably 0.10-0.35 μm, most preferably 0.15-0.20 μm. Keeping the thickness within the above range would make the metal coating film easy to prevent from the generation of crack and easy to follow the curvature of bending.

The conductive yarn is thermally shrunk through heating in the process of forming a metal coating film and/or the next drying process.

The resistance value which is an index of conductivity of the conductive yarn is preferably 500 Ω/m or less. Keeping the residence value within the above range would provide high conductivity and excellent performances as a conductive woven fabric for an electric circuit or the like. More preferably, the resistance value thereof is 350 Ω/m or less.

Examples of fibers forming a non-conductive yarn include natural fibers such as cotton and hemp, recycled fibers such as cupra and rayon, and synthetic fibers such as nylon, polyester and acrylic fiber, though not particularly limited.

Among them, synthetic fibers are preferable in terms of strength and general versatility. Polyester is more preferable in terms of keeping high shape stability even after a heat-shrinking process as described hereinafter. Examples of polyester include polyethylene terephthalate (PET), polybutylene terephthalate (PBT) and polytrimethylene terephthalate (PTT).

Preferable forms of a yarn include a filament yarn such as a monofilament yarn and a multifilament yarn. Either one of them can be used. A multifilament yarn is more preferable.

It is preferable that total fineness of the non-conductive yarn is equal to that of the conductive yarn. That is, total fineness of the non-conductive yarn is preferably 110 dtex or less, more preferably 50 dtex or less. In order to improve the strength of the woven fabric, total fineness thereof is preferably at least 22 dtex, more preferably at least 33 dtex.

Regarding the number of filaments of the non-conductive yarn, it is also preferable to be equal to that of the conductive yarn. That is, the number of filaments in the non-conductive yarn is preferably at least 5, more preferably at least 10.

The single fiber fineness of the non-conductive yarn is preferably 7 dtex or less, from the viewpoint of shape stability.

The non-conductive yarns used for the present invention are consisting of the parallel non-conductive yarns and the orthogonal non-conductive yarns. In the case that warp is consisting of non-conductive yarns and weft is consisting of conductive yarns and non-conductive yarns, the non-conductive yarns used for warp are "the orthogonal non-conductive yarn" and the non-conductive yarn used for weft is "the parallel non-conductive yarn". In the case that weft is consisting of non-conductive yarns and warp is consisting of conductive yarns and non-conductive yarns, the non-conductive yarn used for weft is "the orthogonal non-conductive yarn" and the non-conductive yarn used for warp is "the parallel non-conductive yarn".

It is important that a shrinking-processed yarn is used for the parallel non-conductive yarn. In other words, the ratio of the heat shrinkage percentage of the parallel non-conductive yarn to the conductive yarn is within a specific range. In detail, the heat shrinkage percentage of the parallel non-conductive yarn (Ns) to the heat shrinkage percentage of the conductive yarn (Ds) (=Ns/Ds) is preferably within the range of 0.25 to 1.75. For more detail, regarding the lower limit of the ratio (Ns/Ds), it is more preferable that Ns/Ds is at least 0.5, further preferably at least 0.85, most preferably at least 0.95. Regarding the upper limit of Ns/Ds, it is more preferable that Ns/Ds is 1.5 or less, further preferably 1.15 or less, most preferably 1.05 or less.

The heat shrinkage percentage according to the present invention is a value obtained by immersing a yarn in hot water of 100° C. for 30 minutes. In detail, a predetermined length is measured and fixed in a yarn under an initial loading condition. Then, the yarn is immersed into hot water to heat treatment at 100° C. for 30 minutes under no load. Taken out from water, the yarn is subjected to water removal and drying treatment. The predetermined length of the yarn before heat treatment is measured again under the same initial loading condition and the heat shrinkage percentage is calculated using the following formula 1. More precisely, in the case that the yarn is formed by synthetic fibers or recycled fibers, the measurement is carried out according to JIS-L-1013.8.18.1(b) and the initial loading is determined by "3.2 mN×(Indicated Tex Number)". In the case that the yarn is formed by natural fibers, the measurement is carried out according to JIS-L-1095.9.24.3-C and the initial loading is determined according to JIS-L-1095.6.1.

$$\text{Heat Shrinkage Percentage}(\%)=[(Lb-La)/Lb]\times 100 \quad \text{<Formula 1>}$$

Lb: Length before test (mm)

La: Length after test (mm)

Since the conductive yarn has already been subjected to high temperature in the metal coating film-forming process and/or the next drying process as mentioned above, it is in a state of already shrunk similar to a shrinking-processed yarn. Therefore, the heat shrinkage percentage of the conductive yarn is relatively low.

However, yarns used for common woven fabrics, such as non-conductive yarns used in the present invention, normally do not undergo a high temperature treatment. Therefore, the heat shrinkage percentage of common non-conductive yarns is relatively high. When a fabric is woven from common non-conductive yarns and conductive yarns, distortion in the fabric caused by the difference of shrinkage generated at the time of heat-setting and/or scouring to the conductive woven fabric thus obtained might occur, which might bring about the generation of wrinkles or curls and/or deterioration of shape stability.

In terms of shape stability, the heat shrinkage percentage of the parallel shrinking-processed non-conductive yarn and the conductive yarn is preferably not more than 3%, more preferably not more than 1.5%.

According to the present invention, using a shrinking-processed yarn as the parallel non-conductive yarn and making the heat shrinkage percentage of the parallel non-conductive yarns almost equal to that of the conductive yarns, the fundamental physical properties of the parallel non-conductive yarn such as the degree of extension and the rupture point can be approximated to that of the conductive yarn.

Although the orthogonal non-conductive yarn is not necessarily a shrinking-processed yarn, the heat shrinkage percentage thereof is preferably not more than 7%, more preferably not more than 5.5% in terms of preventing bowed filling.

The shrinking-processed yarn of the present invention can be produced by heat treatment of a yarn at high temperature such as 100° C. or higher, more preferably at 110 to 130° C. More precisely, it can be obtained by shrinking processing under a steam at a temperature of 115 to 125° C., for 30 to 50 minutes of processing time. More preferably, it can be obtained by heat treatment under a high humidity and high-pressure condition (wet heat treatment). Further preferably, it can be obtained by conducting wet heat treatment using a vacuum steam setter or a vacuum steamer.

According to the present invention, since the shrinking-processed yarn is preliminary subjected to shrinking processing to shrink sufficiently before weaving, it is almost completely shrunk. Therefore, even heat is applied to the entire woven fabric at the time of heat-set process or the like after woven, such application of heat hardly causes shrinkage such as wrinkle and/or curl which might bring about significant change in shape of the woven fabric.

It is preferable that the ratio of the diameter of the non-conductive yarn, including both of parallel non-conductive yarn and orthogonal non-conductive yarn, to that of the conductive yarn is within a specific range. In detail, the ratio of the diameter of the non-conductive yarn (Nr) to the diameter of the conductive yarn (Dr) (=Nr/Dr) is preferably 0.9-1.1, more preferably 0.95-1.05.

When the diameters Nr and Dr are almost equal to each other, a conductive woven fabric wherein the conductive part and the non-conductive part are both smooth can be obtained.

According to the present invention, a conductive woven fabric is produced using non-conductive yarns for one of weft and warp, and using non-conductive yarns and conductive yarns for the other of weft and warp.

The part wherein the weft and the warp are both consisting of non-conductive yarns forms a non-conductive part. The part wherein either one of the weft and the warp is consisting of conductive yarns forms a conductive part.

The conductive part of the conductive woven fabric of the present invention is consisting of at least two conductive yarns adjacent to each other wherein a current can pass in both warp and weft directions. The conductive woven fabric of the present invention can carry a current at this conductive part which enables electrical connection with other circuits or the like. Examples of electrical connecting means include soldering, adhesion by conductive tapes and sewing with metal fibers.

The number of conductive yarns adjacent to each other forming the conductive part is not particularly limited if it is two or more. This number can be determined properly depending on the conditions such as the usage of the conductive woven fabric, the type of electrical connecting means and the size of the connecting area.

It is preferable that the number of the conductive yarns adjacent to each other forming the conductive part is at least 6, more preferably at least 10, further preferably at least 50.

The conductive part of the present invention is formed of a repeating woven structure wherein the conductive yarns pass through the upper side of at least two of orthogonal non-conductive yarns and then pass through the back side of at least one of orthogonal non-conductive yarns. Examples of the woven structure of the conductive part include a twilled fabric, a satin fabric and derivative woven fabrics thereof. Considering the balance of conductivity and shape stability, a twilled fabric is preferable.

Although the woven structure of the non-conductive part wherein both weft and warp are consisting of non-conductive yarns is not particularly limited, it is preferable to choose the same woven structure as that of the conductive part.

In the present invention, the upper side of orthogonal non-conductive yarns means the upper surface of the conductive woven fabric on which a connection area with an electrical connection means is provided when it is used for a conductive member. The back side of orthogonal non-conductive yarns means an opposite side of the upper surface.

Since the above-mentioned woven structure of the conductive part generates connecting points between adjacent conductive yarns, a current can be carried in both warp and weft directions, which makes the conductive woven fabric excellent in conductivity. In addition, since the conductive yarns have conductivity by themselves, the conductive woven fabric exhibits excellent durability after repeated bending.

Although the number of orthogonal non-conductive yarns of which the conductive yarns pass through the upper side suffices with two or more, the conductive yarns preferably pass through the upper side of three or more, further preferably four or more of the orthogonal non-conductive yarns for more excellent conductivity.

Although the number of orthogonal non-conductive yarns of which the conductive yarns pass through the back side suffices with one or more, the number of two or more is preferable in order to improve shape stability and strength of the woven fabric.

In terms of further improvement of shape stability and strength of the woven fabric, it is most preferable that the conductive yarns pass through the upper side of 2-7 of orthogonal non-conductive yarns and then pass through the back side of 2-7 of orthogonal non-conductive yarns.

FIG. 1 shows an outline drawing of a conductive woven fabric which is one of the embodiments of the present invention.

As shown in FIG. 1, the conductive woven fabric 1 of the present invention is consisting of conductive yarns 2 and non-conductive yarns 3. The conductive parts 4 and non-conductive parts 5 are alternately arranged side-by-side.

The square surrounding section of FIG. 1 is shown enlarged in FIG. 2. According to this embodiment, the conductive yarns 2 and the non-conductive yarns 3' are used as weft and the non-conductive yarns 3 are used as warp to form a woven fabric having the woven structure of 2/2 twill. Here, the woven structure "2/2" means "(the number of orthogonal non-conductive yarns wherein the conductive yarns pass through the back side thereof)/(the number of orthogonal non-conductive yarns wherein the conductive yarns pass through the upper side thereof)".

The surface exposure area ratio of the conductive yarns in the conductive part is preferably at least 40% in terms of conductivity. Here, the surface exposure area ratio is the ratio of the area wherein the conductive yarns are exposed on the surface, or upper side, of the conductive part to the total surface area of the conductive part.

On the other hand, the surface exposure area ratio is preferably at most 80% in terms of forming adequate number of intersection points by the warp and weft to prevent deterioration of shape stability. The surface exposure area ratio can be obtained by, using a textile weave pattern such as FIG. 2, geometrically calculating the area ratio which the conductive yarns 2 are exposed on the upper side in the conductive part 4.

According to the above calculating method using a textile weave pattern, however, some errors caused by the difference of the diameter of yarns or the like might be observed.

In order to obtain the surface exposure area ratio more accurately, another calculating method can also be employed such that image processing of the conductive part and non-conductive part is carried out by imaging a part of the surface of the conductive wove fabric by means of photomicroscopy. More precisely, the surface exposure area ratio can be obtained by taking a photograph of the surface of the conductive woven fabric by means of an electronic microscope and then calculating the area ratio using image processing software such as "ImageJ" or the like.

The conductive woven fabric of the present invention has at least one of the above-described conductive parts thereon. As shown in FIG. 1, for example, two or more conductive parts can be placed on the total area of the woven fabric. The number and/or the shape of the conductive parts are not particularly limited and can be determined according to the intended use, the type of electrical connecting means, the shape and/or the size of connecting part and the like.

The ratio of the total area of conductive parts to the area of the entire conductive woven fabric can also be determined according to the intended use, the type of electrical connecting means, the shape and/or the size of connecting part and the like.

It is preferable that the ratio of the total area of conductive parts to the entire area of the conductive woven fabric is 30 to 70%, more preferably 40 to 60%.

In terms of improving weaving efficiency and downsizing, the weaving density of the conductive woven fabric is preferably not more than 300/2.54 cm, more preferably not more than 200/2.54 cm.

For the purpose of improving conductivity and bending durability, the weaving density is preferably not less than 100/2.54 cm, more preferably not less than 150/2.54 cm.

The process of the present invention is for producing a conductive woven fabric consisting of multiple weft yarns and multiple warp yarns and having at least one conductive part. It comprises a process of forming the conductive part, using non-conductive yarns as one of weft and warp and using conductive yarns and shrinking-processed non-conductive yarns as the other of weft and warp, by repeatedly weaving so that said conductive yarns pass through the upper side of at least two of orthogonal non-conductive yarns and then pass through the back side of at least one of orthogonal non-conductive yarns.

Performances of conductive yarns and non-conductive yarns to be used, forms of the woven structure to be woven and the like are same as described above.

It is important that the ratio of the heat shrinkage percentage of the parallel shrinking-processed non-conductive yarn (Ns) to the heat shrinkage percentage of the conductive yarn (Ds) is within a specific range. In detail, "Ns/Ds" is preferably within the range of 0.25 to 1.75. For more detail, regarding the lower limit of the ratio (Ns/Ds), it is more preferable that Ns/Ds is at least 0.5, further preferably at least 0.85, most preferably at least 0.95. Regarding the upper limit of Ns/Ds, it is more preferable that Ns/Ds is 1.5 or less, further preferably 1.15 or less, most preferably 1.05 or less.

Following to the above-described weaving process, several processes such as a heat-set treatment process, a scouring process and a heat-drying process can be carried out.

The heat-drying process is typically carried out by passing through a dried space which is kept at a definite temperature using a mechanical device called "heat setter" or "tenter".

Preferable conditions for these processes are as follows: The heat-set treatment process after weaving is carried out at a temperature of 110-190° C., more preferably 140-160° C., for 30-90 seconds, more preferably for 45-75 seconds.

The scouring process is carried out at a temperature of 20-95° C., more preferably 60-90° C.

The heat-drying process following to the scouring process is carried out at a temperature of 170-200° C., more preferably 185-195° C., for 30-90 seconds, more preferably 45-75 seconds.

The heat-set treatment process after weaving and the heat-drying process after scouring don't apply enough heat for making common weaving yarns shrunk completely. Therefore, common weaving yarns are not shrunk completely at this stage. As a result, if heat is applied to the final woven fabric product thus obtained, yarns might be shrunk to cause shape distortion such as wrinkle and/or curl which might hinder conductivity.

According to the present invention, a shrinking-processed yarn having a low shrinkage percentage which is well shrunk by pre-shrinkage treatment is used as a parallel non-conductive yarn. Therefore, even when heat is applied later, the final woven fabric product thus obtained hardly causes a shape deformation such as wrinkles and/or curls which might impair its performances as a conductive woven fabric.

The conductive woven fabric of the present invention can be obtained by executing above-described processes such as a weaving process, a heat-set treatment process, a scouring process and a heat-drying process in sequence, and then a resin coating film forming process as described below can be carried out.

Afterward, for example, a circuit having the size suitable for intended use can be produced by press-cutting the fabric.

It is preferable that a resin coating film is formed on the surface of the surface of the conductive woven fabric. Examples of the resins for forming the film include an acrylic resin, a urethane resin, a melamine resin, an epoxy resin, a polyester resin, a polyamine resin, a vinyl ester resin, a phenol resin, a fluorine resin and a silicone resin. Among them, a polyester resin having low moisture absorbency is more preferable in terms of corrosion protection.

Although, the thickness of the resin coating film is not particularly limited, it is preferably 0.1 to 20 μm.

Examples of methods for forming the resin coating film include publicly known methods such as coating, laminating, impregnating, dip laminating and the like.

The thickness of the conductive woven fabric is preferably not more than 0.3 mm, more preferably not more than 0.25 mm, further preferably not more than 0.2 mm, most preferably not more than 0.15 mm, in terms of downsizing and weight saving.

In terms of bending durability, on the other hand, the thickness of the conductive woven fabric is preferably not less than 0.10 mm, more preferably not less than 0.12 mm. When the fabric is too thin, bending durability might be deteriorated.

Bending resistance of the conductive woven fabric according to a cantilever method is preferably not more than 100 mm, more preferably not more than 70 mm. Having the above range of bending resistance can suppress the increase of resistance at the time of bending.

The conductive member of the present invention comprises the above-described conductive woven fabric and a support body, and has at least one linear bending part wherein an electrical current can pass over the linear bending part to provide conductivity.

In particular, the conductive member can be obtained by fixing a support body onto the backside of the conductive woven fabric. Materials of the support body are not particularly limited as long as they can support the conductive woven fabric. Examples of materials for the support include metals, ceramics, resins and papers. Complexes made by combining more than one of materials can also be used.

The support body has at least one linear bending part. The linear bending part can be a mechanical structure such as a hinge brace. It can also be a structure partially using flexible resin materials.

Although the installation position of the linear bending part is not particularly limited, it can be placed on the orthogonal direction of the longitudinal direction of the conductive part. It can also be placed on more than one of the conductive parts so as to pass across the width direction thereof.

EXAMPLES

The present invention will be described in more detail below referring to examples. Note that the scope of the present invention is not limited by the following examples.

Evaluations of the following Examples and Comparative Examples were carried out by the methods shown below. The results are shown in Table 1 and Table 2.

<Method of Measuring Physical Properties>

1. Total Fineness

Total fineness was measured according to the method "JIS-L-1013-8.3.1-B".

2. The number of filaments of a yarn

The number of filaments of a yarn was measured according to the method "JIS-L-1013-8.4".

3. Single Fiber Fineness

Single fiber fineness was measured by dividing the total fineness of a yarn by the number of filaments thereof.

4. Weaving Density of Woven Fabric

A weaving density of the woven fabric was measured according to the method "JIS-L-1096-8.6.1-A".

5. Thickness of Woven Fabric

The thickness of the woven fabric was measured according to the method "JIS-L-1096-8.4-A".

6. Resistance Value of Yarn

A 10 cm long conductive yarn was cut out to provide a test piece and the resistance value was measured by pinching at both ends of the cut yarn by a clip type probe of a resistance meter named "mΩ HiTESTER", manufactured by HIOKI E.E. CORPORATION. Measurement was carried out 5 times and an average was obtained.

7. Measurement Test of Heat Shrinkage Percentage of Yarn

A 500 mm length was measured in a sample yarn under a loading condition and the length was determined. Then, the sample was immersed into hot water to heat treatment at 100° C. for 30 minutes under no load. Taken out from water, the sample was dried by absorbing water with absorbent paper and/or cloth, and was then subjected to air drying. The length of the sample yarn which had been determined before heat treatment was measured again under the same loading condition and the heat shrinkage percentage (%) was calculated using the following formula 2. The above measurement test was carried out 5 times and an average was obtained. The loading was determined by "3.2 mN×(Indicated Tex Number)".

$$\text{Heat Shrinkage Percentage}(\%)=[(Lb-La)/Lb]\times 100 \quad \text{<Formula 2>}$$

Lb: Length before test (mm)

La: Length after test (mm)

8. Bending Resistance

Turning the upper side of the conductive woven fabric up, bending resistance was measured according to JIS-L-1096.8.21.1A (2010) cantilever method at a longitudinal direction and a lateral direction for each.

9. Diameter of Yarn

The diameter of a sample yarn was measured by a microscope (magnification: ×200). The measurement was carried out 5 times and an average was obtained.

10. Surface Exposure Area Ratio

A 200-enlarged photographic image of the surface of a conductive woven fabric was taken by means of a scanning electron microscope (SEM). The photographic image thus taken was an image wherein the conductive yarn was shown white and the non-conductive yarn was shown black.

The size of the white conductive yarn area was measured using an image processing software named "ImageJ", while tuning contrast if necessary, to obtain a surface exposure area rate of the conductive yarn to the entire conductive part.

<Evaluation>

1. Bending Durability

A test piece was subjected to a bending test and a residence value was measured before and after the bending test. Bending durability was evaluated by calculating the resistance increase ratio before and after the bending test.

1) Bending Test

The bending test was carried out using "MIT TYPE FOLDING ENDURANCE TESTER" manufactured by Toyo Seiki Seisaku-sho, Ltd., under the following conditions. Three test pieces were prepared for each direction of lengthwise and crosswise in the conductive part.

The number of bending: 20,000
Bending Radius: 0.38 mm
Bending Speed: 175 cpm
Bending Angle: ±135°
Load: 0 kg
Sample Size: 100 mm×10 mm 2) Measurement of Resistance Value The resistance value was measured by pinching at both ends in the longitudinal direction of the test piece by a clip type probe of a resistance meter named "mΩ HiTESTER", manufactured by HIOKI E.E. CORPORATION.

Regarding the resistance value after bending test, a resistance value was measured for 20 times while bending on the front and back sides at a bending part which was a center part in the longitudinal direction, and the maximum value was adopted as the resistance value.

3) Calculation of Residence Increase Ratio

The resistance increase ratio after the bending test to the residence value before the bending test was calculated using the following formula 3:

$$\text{Resistance Increase Ratio}(\%)=[Ba/Bb]\times 100 \qquad \text{<Formula 3>}$$

Ba: The resistance value after the bending test (A)
Bb: The resistance value before the bending test (A)

4) Evaluation of Bending Durability

An average of the calculation results was determined, and evaluation of bending durability was made in accordance with the following criteria:

<Criteria for Evaluation>

◎: Resistance Increase Ratio of less than 5%
○: Resistance Increase Ratio of 5% or more to less than 10%
Δ: Resistance Increase Ratio of 10% or more to less than 20%
x: Resistance Increase Ratio of 20% or more 2. Conductivity (Initial Resistance Value)

The above-described resistance value before bending test according to the above 1. was used for evaluation of conductivity.

<Criteria for Evaluation>

◎: The resistance value of less than 0.2 (Ω)
○: The resistance value of 0.2 (Ω) or more to less than 0.5 (Ω)
Δ: The resistance value of 0.5 (Ω) or more to less than 0.8 (Ω)
x: The resistance value of 0.8 (Ω) or more 3. Shape Stability 1) Calculation of Shape Stability Factor Three square-shaped test pieces of 200 mm×200 mm were cut out of the woven fabric so that the borderline of a conductive part and a non-conductive part changing to the conductive part comes to the center of said piece. After heat-drying treatment at 130° C. for 3 minutes, a test piece was placed on a surface plate with a flatness of grade 2 or higher of JIS-B-7513, so as not to put a load in any of the three-dimensional directions.

Concavo-convex features caused by wrinkles and the degree of curl caused by the difference of front tension and back tension were measured by using a height gauge. The shape stability factor (%) was calculated by the following formula 4:

$$\text{Shape Stability Factor}(\%)=[(Hc-Tp)/Tp]\times 100 \qquad \text{<Formula 4>}$$

Hc: The height of a convex part (mm)
Tp: The thickness of a test piece (mm)

2) Evaluation of Shape Stability

An average of the calculation results was determined, and then, evaluation of shape stability was made in accordance with the following criteria:

<Criteria for Evaluation>

○: The shape stability factor of less than 10%
Δ: The shape stability factor of 10% or more to less than 30%
x: The shape stability factor of 30% or more 4. Environmental Durability Three test pieces of 100 mm×10 mm were prepared so that the longitudinal direction of the conductive part corresponds to the longitudinal direction of the test piece. The environmental acceleration test was carried out under the following conditions and then the resistance increase ratio before and after the test was measured to evaluate environmental durability.

1) Environmental Acceleration Test

After immersing into a 5% salt water for 1 minute, the test pieces were sealed up in the wet state and kept under the moist-heat condition of 65° C. with the humidity of 90% for 24 hours.

2) Measurement of Resistance Value

The resistance value was measured by pinching at both ends in the longitudinal direction of the test piece by a clip type probe of a resistance meter named "mΩ HiTESTER", manufactured by HIOKI E.E. CORPORATION.

3) Calculation of Resistance Increase Ratio

The resistance increase ratio after the environmental acceleration test to the residence value before the environmental acceleration test was calculated using the following formula 5:

$$\text{Resistance Increase Ratio}(\%)=[Ea/Eb]\times 100 \qquad \text{<Formula 4>}$$

Ea: The resistance after the environmental acceleration test (Ω)
Eb: The resistance before the environmental acceleration test (Ω)

4) Evaluation of Environmental Durability

Based on the calculation results, evaluation was made in accordance with the following criteria:

<Criteria for Evaluation>

○: Resistance Increase Ratio of less than 10%

Δ: Resistance Increase Ratio of 10% or more to less than 20% x: Resistance Increase Ratio of 20% or more

Example 1

"Yarn A" in Table 1 which was a silver-coated yarn having the coated film thickness of 0.19 μm was used as a conductive yarn for weft. Yarn A was a PET yarn having a total fineness of 40 dtex and a filament number of 12, and had been subjected to electroless plating to form a silver coating film on the surface thereof. The properties of Yarn A were shown in Table 1.

As for the non-conductive yarns, "Yarn F", which was a shrinking-processed PET yarn having a total fineness of 33 dtex and a filament number of 12, were used for both weft and warp. Yarn F had been subjected to shrinking processing by heating using a vacuum steam setter at a temperature of 120° C. for 40 minutes. The properties of Yarn F were shown in Table 1.

Using the above-described Yarn A and Yarn F, a 2/2 twilled fabric was woven using a rapier loom. The weaving density of warp was 170/2.54 cm and the weaving density of weft was 180/2.54 cm. A fabric was woven to make a border pattern wherein the 150 mm long conductive parts and the 150 mm long non-conductive parts were arranged repeatedly.

Then, the fabric was subjected to a heat-set treatment process at 170° C., a scouring process at 90° C. and a heat-drying process at 190° C. in order, and was subsequently subjected to a resin coating film forming process.

In the resin coating film forming process, a resin coating film was formed by an impregnation method using a polyester resin named "PLAS COAT Z-561", manufactured by GOO CHEMICAL CO, LTD. The conductive woven fabric thus obtained was evaluated, and the results of evaluation and properties were shown in Table 2.

Examples 2-8, Comparative Examples 1-2

Conductive woven fabrics were prepared in the same manner as in Example 1, except for changing yarns and weaving conditions as shown in Table 1 and Table 2.

In Table 2, the fabric of Example 8 was woven using conductive yarns and non-conductive yarns as warp, which was different from other examples using conductive yarns and non-conductive yarns as weft. The results of evaluation and properties were shown in Table 2.

In Table 1, "Yarn G" was a shrinking-processed yarn which had been subjected to shrinking processing using a vacuum steam setter at a temperature of 120° C. for 40 minutes in the same manner as Yarn F, while it had different characteristics from Yarn F. Properties of Yarn G are shown in Table 1.

TABLE 1

| Name | A | B | C | D | E | F | G |
|---|---|---|---|---|---|---|---|
| Yarn | Conductive Yarn | Conductive Yarn | Conductive Yarn | Conductive Yarn | Non-conductive Yarn | Non-conductive Yarn | Non-conductive Yarn |
| Material | Silver-plated PET yarn | Silver-plated PET yarn | Silver-plated PET yarn | Silver-plated PET yarn | Non-shrinking processed PET Yarn | Shrinking processed PET Yarn | Shrinking processed PET Yarn |
| Total Fineness (dtex) | 40 | 40 | 110 | 66 | 33 | 33 | 110 |
| Filament Number | 12 | 6 | 48 | 13 | 12 | 12 | 48 |
| Single Fiber Fineness (dtex) | 3.3 | 6.6 | 2.8 | 5.0 | 2.8 | 2.8 | 2.3 |
| Diameter of Yarn (μm) | 60 | 60 | 104 | 77 | 57 | 57 | 100 |
| Resistance Value (Ω/m) | 330 | 331 | 335 | 540 | — | — | — |
| Heat Shrinkage Pecentage (%) | 1.3 | 1.3 | 1.4 | 5.5 | 5.1 | 1.3 | 1.3 |

TABLE 2

| | Example 1 | Example 2 | Example 3 | Example 4 | Example 5 | Example 6 | Example 7 | Example 8 | Comparative Example 1 | Comparative Example 2 |
|---|---|---|---|---|---|---|---|---|---|---|
| Yarns for Warp C.P.: Conductive Part NC.P.: Non-conductive, Part | Yarn F | Yarn E | Yarn E | Yarn E | Yarn E | Yarn E | Yarn E | C.P.: Yarn A NC.P.: Yarn F | Yarn F | Yarn E |
| Yarns for Weft C.P.: Conductive Part NC.P.: Non-conductive Part | C.P.: Yarn A NC.P.: Yarn F | C.P.: Yarn B NC.P.: Yarn F | C.P.: Yarn D NC.P.: Yarn F | C.P.: Yarn A NC.P.: Yarn F | C.P.: Yarn A NC.P.: Yarn F | C.P.: Yarn B NC.P.: Yarn F | C.P.: Yarn C NC.P.: Yarn G | E | C.P.: Yarn A NC.P.: Yarn F | C.P.: Yarn A NC.P.: Yarn E |
| Woven Structure | 2/2 Twill | 2/2 Twill | 2/2 Twill | 1/4 Satin | 2/3 Twill | 2/2 Twill | 1/4 Satin | 2/2 Twill | Plain Fabric | 2/2 Twill |
| Number of conductive yarns passing through the upper side | 2 | 2 | 2 | 4 | 3 | 2 | 4 | 2 | 1 | 2 |

TABLE 2-continued

| | Example 1 | Example 2 | Example 3 | Example 4 | Example 5 | Example 6 | Example 7 | Example 8 | Comparative Example 1 | Comparative Example 2 |
|---|---|---|---|---|---|---|---|---|---|---|
| Number of conductive yarns passing through the back side | 2 | 2 | 2 | 1 | 2 | 2 | 1 | 2 | 1 | 2 |
| Weaving Density (Warp/Weft) (Number of Yarn/2.54 cm) | 170/180 | 170/180 | 170/180 | 170/180 | 170/180 | 170/120 | 170/100 | 180/170 | 170/160 | 170/180 |
| Fabric Thickness μm | 120 | 120 | 121 | 129 | 132 | 112 | 210 | 123 | 134 | 126 |
| Bending Resistance mm | 60 | 58 | 65 | 60 | 57 | 67 | 68 | 63 | 58 | 73 |
| Surface Exposure Area Ratio of Conductive Yarn (%) | 50 | 50 | 50 | 80 | 60 | 50 | 80 | 50 | 50 | 50 |
| Bending Durability | ◎ | ○ | ○ | ◎ | ◎ | Δ | ◎ | ◎ | ◎ | ◎ |
| Conductivity | ○ | ○ | Δ | ○ | ○ | Δ | ○ | ○ | X | ○ |
| Shape Stability | ○ | ○ | Δ | Δ | ○ | Δ | Δ | ○ | ○ | X |
| Environmental Durability | ○ | ○ | ○ | ○ | ○ | ○ | ○ | ○ | ○ | ○ |

EXPLANATION OF REFERENCE LETTERS

1: Conductive woven fabric
2: Conductive yarn
3: Non-conductive yarn (warp)
3': Non-conductive yarn (weft)
4: Conductive part
5: Non-conductive part
▩ Warp: Non-conductive yarn
□ Weft: Non-conductive yarn
▨ Weft: Conductive yarn

INDUSTRIAL APPLICABILITY

The conductive woven fabric of the present invention can keep enough conductivity after a repeated bending. Therefore, it is usable for many downsized devices such as notebook computers, tablet computers and portable game devices having a foldable structure.

The invention claimed is:

1. A conductive woven fabric consisting of multiple weft yarns and multiple warp yarns and having at least one conductive part, wherein one of weft and warp is consisting of non-conductive yarns and the other of weft and warp is consisting of conductive yarns and non-conductive yarns which are parallel to each other, characterized in that said non-conductive yarns parallel to the conductive yarns are shrinking-processed yarns and said conductive part is formed by a repeating woven structure wherein said conductive yarns pass through the upper side of at least two of non-conductive yarns orthogonal to said conductive yarns and then pass through the back side of at least one of non-conductive yarns orthogonal to said conductive yarns.

2. The conductive woven fabric according to claim 1, wherein the rate of the heat shrinkage percentage of the shrinking-processed yarns to the heat shrinkage percentage of the conductive yarns is within the range of 0.25 to 1.75.

3. The conductive woven fabric according to claim 1, wherein said conductive part is formed by a repeating woven structure wherein said conductive yarns pass through the upper side of 2 to 7 of non-conductive yarns orthogonal to the conductive yarns and then pass through the back side of 2 to 7 of the non-conductive yarns orthogonal to the conductive yarns.

4. The conductive woven fabric according to claim 1, wherein the weaving density of warp is within the range of 100/2.54 cm to 300/2.54 cm and the weaving density of weft is within the range of 100/2.54 cm to 300/2.54 cm.

5. The conductive woven fabric according to claim 1, wherein the total fineness of said conductive yarns and non-conductive yarns is each within the range of 22 to 110 dtex.

6. The conductive woven fabric according to claim 1, wherein the resistance value of said conductive yarns is 500 Ω/m or less.

7. A conductive member comprised of a conductive woven fabric according to claim 1 and a support, which has at least one linear bending part and exhibits conductivity over said linear bending part.

8. A process for producing a conductive woven fabric consisting of multiple weft yarns and multiple warp yarns and having at least one conductive part, which comprises a process of forming said conductive part by weaving, using non-conductive yarns as one of weft and warp and using conductive yarns and non-conductive shrinking-processed yarns as the other of weft and warp, by a repeating processing wherein said conductive yarns pass through the upper side of at least two of non-conductive yarns orthogonal to said conductive yarns and then pass through the back side of at least one of non-conductive yarns orthogonal to said conductive yarns.

9. The process for producing a conductive woven fabric according to claim 8, wherein the rate of the heat shrinkage percentage of said shrinking-processed yarns to the heat shrinkage percentage of said conductive yarns is within the range of 0.25 to 1.75.

* * * * *